United States Patent [19]

Willigman

[11] Patent Number: 4,948,928

[45] Date of Patent: Aug. 14, 1990

[54] PUSH/PUSH RESET PROGRAMMER

[75] Inventor: John Willigman, Elk Grove Village, Ill.

[73] Assignee: Eaton Corporation, Cleveland, Ohio

[21] Appl. No.: 394,446

[22] Filed: Aug. 16, 1989

[51] Int. Cl.[5] ..... H01H 43/10

[52] U.S. Cl. ..... 200/38 R; 200/38 A; 200/38 C

[58] Field of Search ..... 200/27 B, 35 R, 38 R, 200/38 A, 38 FA, 38 B, 38 BA, 38 C, 38 CA; 74/568 T

[56] References Cited

U.S. PATENT DOCUMENTS

| | | | |
|---|---|---|---|
| 3,737,597 | 6/1973 | Jones et al. | 200/38 R X |
| 4,146,760 | 3/1979 | Voland | 200/38 A |
| 4,307,270 | 12/1981 | Smock | 200/38 A X |
| 4,412,110 | 10/1983 | Wojtanek | 200/38 A X |
| 4,467,664 | 8/1984 | Willigman et al. | 200/38 B X |
| 4,497,985 | 2/1985 | Courter et al. | 200/38 R |
| 4,497,986 | 2/1985 | Zink et al. | 200/38 R |
| 4,560,846 | 12/1985 | Klopp et al. | 200/38 A X |
| 4,755,635 | 7/1988 | Willigman | 200/35 R |
| 4,796,484 | 1/1989 | Eder | 200/38 A X |

*Primary Examiner*—J. R. Scott

*Attorney, Agent, or Firm*—R. A. Johnston

[57] ABSTRACT

An electromechanical programmer having a user push-push reset action on the shaft of a rotary cam drum for actuating plural appliance function switches. Successive user push movements alternately latch and release the shaft between first and second axial positions. In the first axial position the shaft moves an auxiliary cam to close a line power switch for energizing a motorized cam drum advance and powering the program switches; and, the shaft is free-rotating with respect to the cam drum. In the second axial position the shaft moves an auxiliary cam to open the line power switch; and, the shaft is clutched to the drum to enable user rotation of the drum for appliance program interval selection.

12 Claims, 3 Drawing Sheets

PUSH/PUSH RESET PROGRAMMER

BACKGROUND OF THE INVENTION

The present invention relates to electromechanical programmers or timers as they are sometimes called employed for controlling the cycle of operation or program for an electrically operated appliance. Programmers employed for household appliances such as washing machines, dish washers and clothes dryers typically have a plurality of appliance function switches sequentially operated during a selected program time interval by a rotating cam which is advanced during the program interval by a timing motor advance mechanism. In the more common arrangements of such programmers for household appliances, the programmer is mounted behind the panel; and, the appliance user selects the desired program interval by rotating a knob attached to the shaft for the cam extending through the panel to position the cam initially for providing the selected interval for timeout of the program. It is commonplace to have a dial knob attached to the cam shaft with indicia of a program on the console for user selection of the desired program and interval.

Heretofore, appliance programmers that are user positioned by a rotary knob or dial for selection of the desired program have also incorporated a line power switch actuated by axial movement of the dial knob and cam shaft. Typically, in such programmer arrangements an auxiliary cam is provided on the program cam shaft for actuation of a separate line power switch by the axial movement of the knob. However, a disadvantage of this arrangement has been that it has still been possible for the user to rotate the program cam and cause actuation of the program switches when the line power switch was closed. This rotation caused actuation of the machine function switches for switching current rapidly on and off to the appliance functions. Such rapid operation of the various machine functions by the user rotating the program cam rapidly with the line power switch closed has been found to be harmful to the various machine functions controlled by the program switches.

It has been proposed to provide an appliance programmer wherein the user selects the desired program interval by rotary positioning of a dial or knob for the program switch cam and also to provide a sequential push/push reset action to the knob shaft to require the user to reset the knob shaft to close the line power switch and to prevent the program cam from being rotated when the knob is rotated with the shaft in the nonreset mode. However, in order to provide such a combination of actuations for the appliance user control knob, it has been found difficult to combine these features in a single dial rotary cam electromechanical programmer and to provide the desired push/push reset action for combined control of the program function switches and the line power switch. It has thus been desired to provide a way or means to disengage the program cam from the knob shaft when the line power switch is closed and to require reset of the knob in order to engage the cam with the knob and simultaneously open the line power switch. It has further been desired to provide the aforesaid functions in a simple construction for an electromechanical programmer which is manufacturable at low cost in high volume production.

SUMMARY OF THE INVENTION

The present invention provides an electromechanical programmer for an appliance having a push/push reset action for a control knob user rotated for selecting a desired program interval. The programmer has a rotary program switch cam and provides for separate modes of actuation during which rotary positioning of the knob cannot effect the cam position when the line power switch is closed.

The programmer of the present invention employs a plurality of appliance program function switches disposed about a rotary cam drum shaft mounted for initial user positioning for selection of a desired program interval and axial movement of the shaft for opening and closing the line power switch. The programmer of the present invention provides for alternate push/push actuation of the cam shaft to effect opening and closing of the line power switch and provides for rotary positioning of the program cam drum only when the line power switch is open.

The programmer of the present invention employs a latching mechanism operative to hold an auxiliary cam in a first axial position for closing the line power switch and declutching the rotary program cam from the shaft when the latching mechanism is locked in the first axial position. Subsequent axial movement of the shaft by the user releases the latching mechanism and moves the auxiliary cam to a second axial position in which the line power switch is opened. The shaft is clutched to the cam drum to permit user rotation of the cam drum only in the condition in which the line power switch is open. The present invention thus combines the familiar and desirable features of an appliance programmer wherein the user selects the desired program by rotary positioning of a dial knob. The user effects opening and closing of the line power switch by successive alternate push actuations of the control knob shaft. The programmer of the present invention thus provides for protection against user rapid rotation of the program cam and consequent rapid opening and closing of the program switches when the line power switch is closed which could result in damage to the appliance functions.

DETAILED DESCRIPTION

Figure 1:
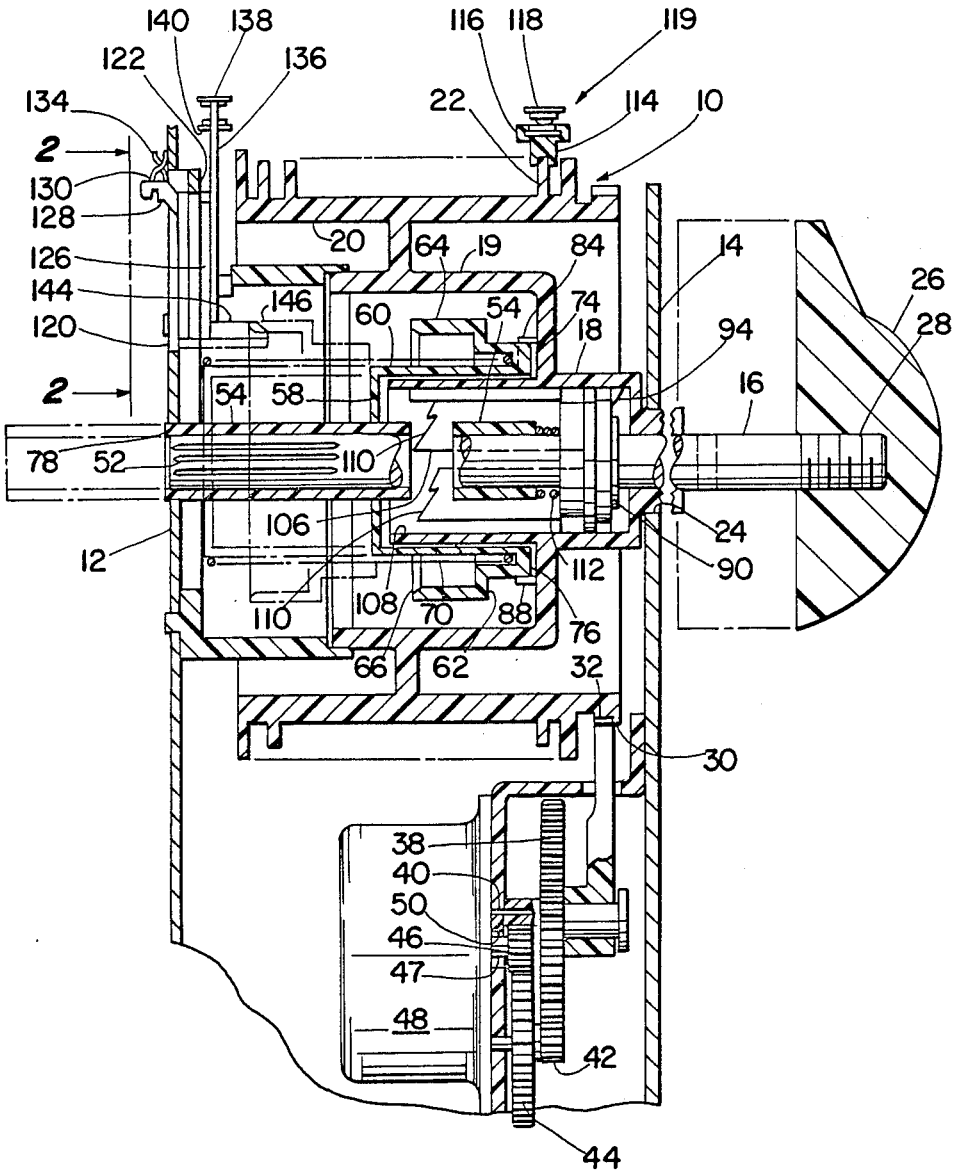
FIG. 1 is a cross section of an appliance programmer employing the present invention.

Referring to FIG. 1, the programmer is indicated generally at 10 as having a housing comprising a pair of spaced plates 12,14 with a shaft 16 extending through apertures provided in the plates and centrally through a hub 18 of a cam drum 20 supported on hub 18 by a web or ribbed portion 19 preferably formed integrally therewith and having a plurality of program cam tracks such as track 22 provided about the periphery thereof. The hub 18 of cam drum 20 is journalled for rotation in aperture 24 provided in the deck plate 14. Shaft 16 is movably received in the hub 18 for axial and rotary movement therein. It will be understood that shaft 16 has the end thereof extending outwardly through hub 18 and provided with threads 28 on the end thereof for attachment of user dial knob 26 threadedly attached thereon.

Drum 20 has provided thereon and preferably integrally therewith a toothed ratchet wheel 30. The peripheral teeth of ratchet 30 are engaged by an advance pawl having a chisel point 32 shown engaged with the ratchet wheel 30 in FIG. 1. The pawl has a hub 34 which is received over an eccentrically mounted pin 36 which orbits on a driven gear wheel 38 journalled for rotation about pin 40 mounted on deck plate 12. Gear 38 is meshed with and driven by a driving pinion 42 which is driven by gear 44 journalled for rotation on deck plate 12.

Motor pinion 46 is attached to the shaft 47 of motor 48 mounted on the exterior of deck plate 12 with pinion 46 extending through an aperture 50 provided in the deck plate 12. Pinion 46 is meshed with and drives gear 44.

Figure 3:
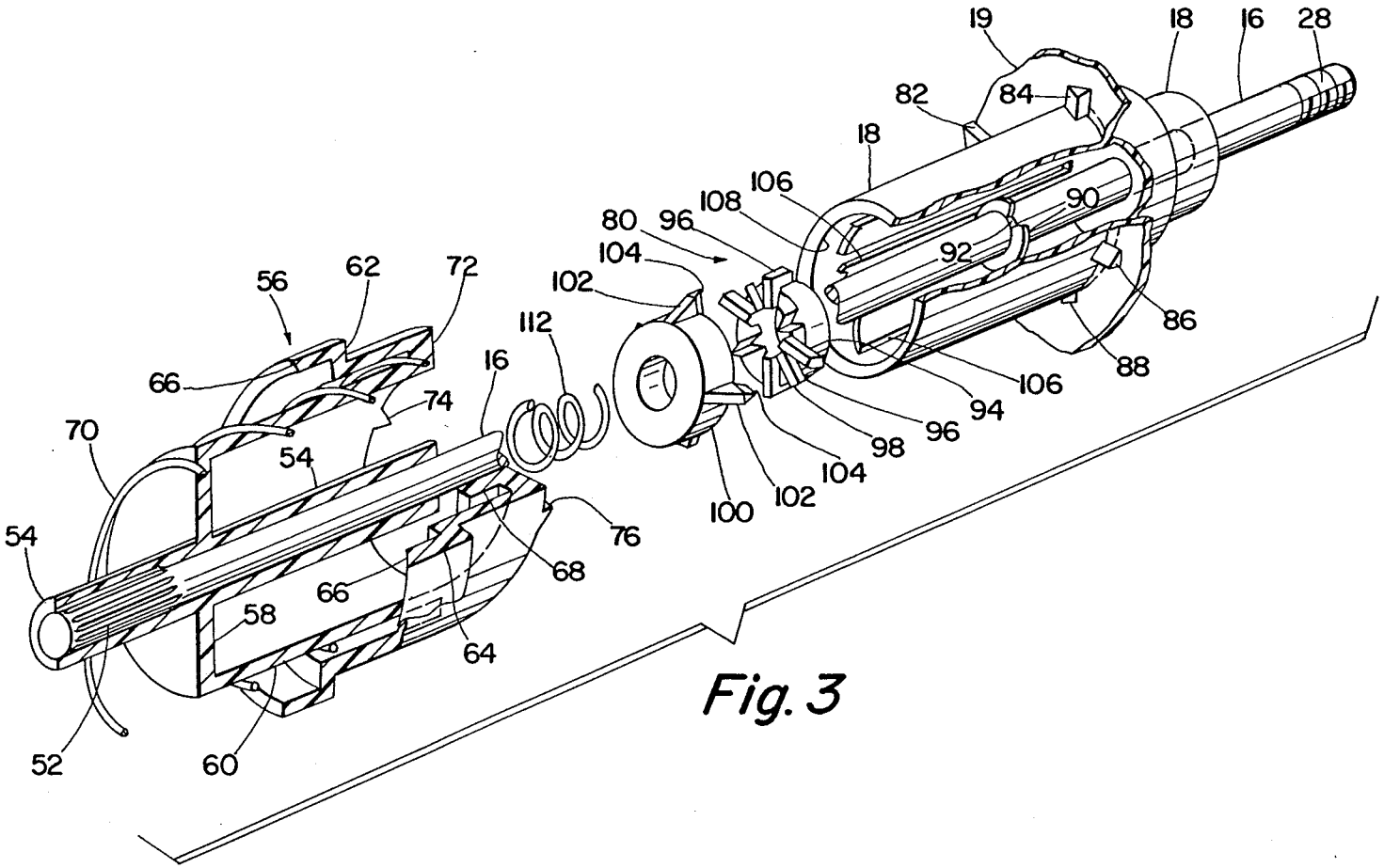
FIG. 3 is a somewhat pictorial exploded view of the auxiliary cam, clutch and latching mechanism of the programmer of FIG. 1.

Referring to FIGS. 1 and 3, shaft 16 has a plurality of knurls or raised ribs 52 provided on the end opposite the threads 28. The hub 54 of an annular auxiliary cam member 56 is pressed thereon in an interference engagement such that shaft 16 can transmit torque to the hub 54.

Auxiliary member 56 includes a radial web 58 which supports an outer annular shell 60 which is open at the end remote from the knurled portion. The open end of auxiliary cam member 56 has a flange 62 extending radially outwardly from the outer periphery thereof which flange has an annular portion 64 formed about the outer periphery thereof and extending axially in a direction toward the knurled end of the shaft 16. The axial end the annular portion 64 has a chamfer or tapered surface 66 provided on the opened end thereof which surface 66 defines an auxiliary cam surface for operating a line power switch as will hereinafter be described in greater detail.

An annular groove 68 is provided in the end of the member 56 and disposed radially between the portion 64 and the cylindrical portion 60. Groove 68 has received therein one end of a spring 70.

The open end of cam member 56 has provided on the end face 72 thereof a plurality of circumferentially spaced teeth or clutch dogs indicated by reference numerals 74,76 in FIG. 3.

It will be understood that the outer periphery of the hub 54 of the auxiliary cam member 56 is received through an aperture 78 provided in the deck plate 12 and the hub is movable axially and in rotation with respect to the aperture 78.

With reference to FIGS. 1 and 3, a rotary latching mechanism indicated generally at 80 is provided for retaining the shaft and auxiliary camming member 56 in a first axial position indicated in dashed outline in FIG. 1 when the appliance user moves the knob 26 by pushing in a leftward direction with respect to FIG. 1. Upon the user again pushing knob 26 a slight amount further in the leftward direction from the first position shown in dashed outline, the latch mechanism 80 is operative to release the auxiliary cam member 56 to be moved by spring 70 to a second axial position indicated in solid outline in FIG. 1.

In the second axial position the clutch dogs 74,76 are operative to interdigitate with a corresponding set of circumferentially spaced clutch dogs provided on the web 19 of the cam drum. These latter are indicated by reference numerals 82,84,86 and 88 and which provide driving power to the web 19 of the drum in one direction of rotation of the shaft 16 and are preferably overrunning when shaft 16 is rotated in the opposite direction.

Referring to FIG. 3, the rotary latch mechanism 80 includes a retaining ring 90 received in a groove 92 formed in shaft 16. An annular latching member 94 has a plurality, preferably eight, radially extending teeth provided on the face thereof circumferentially equally spaced thereabout with four of the teeth extending radially outwardly in quadrature from the periphery of the annular latching member 94. The alternately spaced remaining four teeth terminate at the outer periphery of the annular latching member 94. All of the teeth indicated typically by reference numerals 96,98 in FIG. 3 are chamfered to a wedge shaped edge on the axial face thereof.

The annular latching member is received over shaft 16 and is freely rotatable thereabout and the outer periphery thereof is configured for nesting within the cylindrical surface of the hub 18 of the cam drum. The axial face of annular latching member 94 is registered against the face of retaining ring 90.

An annular indexing member 100 is received over shaft 16 and has a plurality of radially outwardly extending lugs provided on the outer periphery thereof indicated typically by the reference numeral 102 and have the axial face of the lugs chisel pointed as denoted by reference numeral 104. The chisel pointed axial faces 104 make contact with the chamfered surfaces of the lugs 96,98 on annular latching member 94 and cause the annular indexing member 100 to rotate until the lugs 102 are nested between the lugs 96,98 on member 94.

The hub 18 of the cam drum has a plurality of circumferentially spaced longitudinally extending grooves 106 provided on the inner periphery thereof which grooves extend longitudinally substantially the length of the hub 18. The end of hub 18 has the inner periphery thereof remote from web 19 counterbored or relieved outwardly such that a shoulder is formed with the inner periphery in which the grooves 106 are formed. The outwardly relieved diameter is denoted by reference numeral 108 in the drawings. The axial end of the shoulders formed by relieve diameter 108 are configured in the form of helical notches 110 denoted by reference numeral 110.

It will be understood that the radially extending lugs 96 extend outwardly substantially to the relieved diameter 108 and are therefore trapped within the grooves 106. It will also be understood that the radially extending lugs 102 on collar 100 extend outwardly substantially to the relieved diameter 108. The lugs 102 are alternately engaged in the grooves 106 or the chisel pointed axial faces 104 of lugs 102 are engaged with the helical notches 110. When lugs 102 are engaged in the grooves 106 the shaft 16 and the auxiliary cam member 56 are permitted to slide axially the length of the hub to said second axial position as indicated in solid outline in FIG. 1. When the chisel pointed axial faces 104 of lugs 102 are engaged with the helical notches 110 the shaft 16 and the annular member 56 are retained in said first axial position as indicated in dashed outline of FIG. 1.

The annular indexing member 100 is biased against the member 94 by a coil spring 112 which has one end registered against the end of cam member hub 54 and the other end registered against the axial face of collar 100. The member 100 is thus maintained in contact with auxiliary cam member 94 and against retaining ring 90 by spring 112.

The cam member 56 and the shaft 16 are urged rightward in the drawing by the spring 70 in the annular groove 68 in a direction tending to engage the latch dogs 76 with dogs 86 on the web of the cam drum 19. The remaining end of spring 70 being registered against the inner surface of the deck plate 12.

It will be understood that upon the user pushing knob 26 on shaft 16 leftward the annular indexing member 100 alternately has its radially extending lugs 102 registering against notches 110 for holding the shaft in the first axial position as shown in dashed outline in FIG. 1, and sliding in the grooves 106 to permit the shaft to move to the second axial position shown in solid outline in the drawings. The shaft is thus latched in the first axial position with one push of the knob and is released to the second axial position with the next successive user push and release of the knob. With reference to FIG. 1, the first axial position of the knob is shown in dashed outline and the second axial position shown in solid outline.

Referring to FIG. 1, the program cam track 22 on cam drum 20 is shown engaged by a cam follower 114 which is attached to one contact blade 116 of a switch for making and breaking contact with an upper switch contact blade 118 for controlling a desired appliance function by rotation of the cam drum during the program interval.

Figure 2:
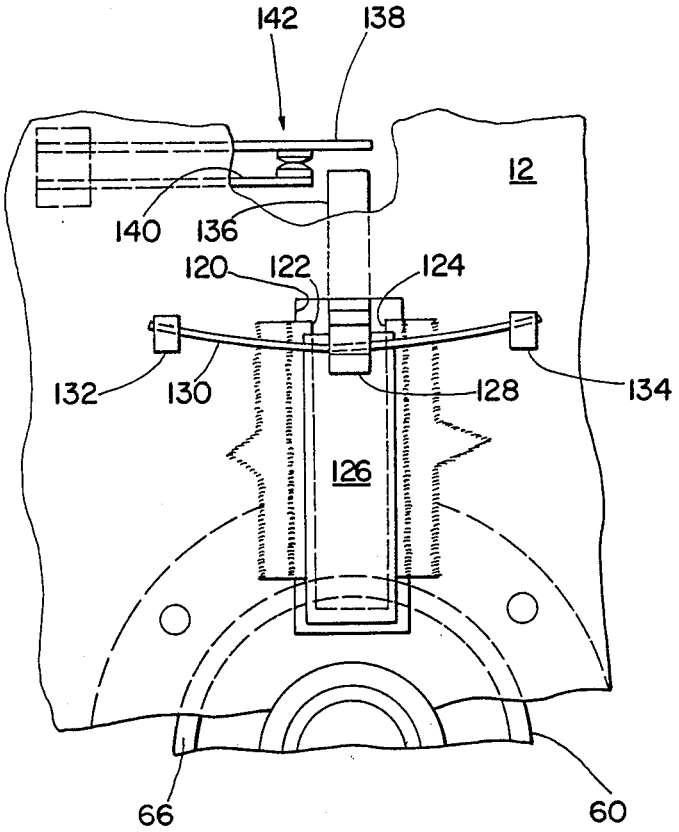
FIG. 2 is a view taken along section indicating line 2—2 of FIG. 1.

Referring to FIGS. 1 and 2 deck plate 12 has a slot or cut out 120 formed therein with the longitudinal edges thereof deformed to extend inwardly of the interior of the deck plate to provide a pair of spaced parallel rails or guide surfaces 122,124.

A slider member 126 is slidably received between rails 122,124 and has a lug 128 which extends through slot 120 to the outer surface of deck plate 12. The lug 128 is notched to receive a beam spring 130 having its opposite ends anchored and tabs 132,134 formed in the deck plate thereby bowing spring 130 to bias the slider 126 in an upward direction.

Slider 126 has a vertical extension 136 which is operative for contacting an upper contact blade 138, which together with lower contact blade 140 comprises a line power switch indicated generally at 142. Slider 126 has a horizontally extending member or foot 144 which extends therefrom in a direction parallel to the outer annular surface 64 of the auxiliary cam member 56. The horizontal foot 144 has a chamfered or inclined end surface 146 which functions as a camming surface.

When auxiliary cam member 56 is moved to its first axial position shown in dashed outline in FIG. 1, the annular camming surface 66 cams against the surface 146 on the slider 126 and moves the slider to its downward position shown in dashed outline in FIG. 1 and in solid outline in FIG. 2.

When the slider 126 is in the downward position, the upper contact blade of switch 142 makes contact with the lower contact blade 140 thereby making a circuit for the line power to energize motor 48 and the program switch 119. When the auxiliary cam member 56 is moved to the second axial position indicated in solid outline in FIG. 1, slider member 126 is moved to the upward position shown in FIG. 1 in solid outline in which the vertical extension 136 moves the upper contact blade 138 of line power switch 142 upwardly to break contact with the lower contact blade 140 thereby opening the line power circuit to motor 48.

It will be understood that the operation of the clutching of the shaft 16 to the cam drum may be reversed, e.g., declutched when the shaft is out. This may be accomplished simply by reversing the positions of the latching mechanism and clutch dogs 76, 84 and cam drum web 19 on the shaft 16 so that engagement occurs when the auxiliary cam member 56 is in the leftward position shown in dotted outline in FIG. 1. In such an arrangement, the camming of switch contacts would also be reversed such that upward movement of slider 126 would effect closing of the contact blades 138, 140.

The present invention thus provides a simplified and low cost construction of an electromechanical appliance programmer in which the user knob is attached to a rotary program cam shaft and is rotatable for selecting the desired program interval for the appliance. The user knob is pushed to latch in a first axial position to close the line power switch which is series connected to the cam drive motor and the appliance program switches. When the knob is axially latched in the first position closing the line power switch, the knob shaft is declutched from and is freely rotatable with respect to the program cam drum. Upon the user successively pushing and releasing the knob and shaft the latch releases and the auxiliary cam member moves axially to a second position releasing the slider to open the line power switch and simultaneously rotatably clutches the knob shaft to the cam drum to enable the user to rotate the cam drum to select the desired program interval. The present invention thus provides an electromechanical appliance programmer having a push/push reset action to the control knob to prevent user rotation of the cam drum when the line power switch is closed. The present invention retains the desirable and widely used feature of user selection of a desired appliance program interval by rotating a dial knob to a position indicative of the desired program interval.

The present invention has hereinabove been described with respect to the illustrated embodiments; however, it will be understood that the invention is capable of alteration, modification and variation and is limited only by the scope of the following claims.

I claim:

1. A push-push reset electromechanical programmer assembly for an appliance comprising:

(a) base means including motorized advance means;

(b) a cam drum mounted for rotary movement on said base means and having at least one program cam track thereon, said drum operatively connected for timed advancement by said advance means;

(c) at least one program switch means adapted for controlling an appliance function including follower means operable to make and break a set of electrical contacts in response to advancement of said cam drum;

(d) line switch means operative upon connection to a source of power to control current flow to said motorized advance means;

(e) slider means disposed on said base means and movable between first and second positions for respectively actuating and deactuating said line switch means;

(f) shaft means disposed on said base means concentrically with said cam drum and movable axially with respect thereto between first and second positions, said shaft means including switch cam means operable upon being moved to a first axial position with respect to said base means to move said slider means to said first position;

(g) releasable means operable to retain said shaft means in said first axial position, said releasable means operable, upon subsequent user axial movement of said shaft means and user release thereof to move said switch cam means to a second axial position permitting said slider means to move to said second position; and (h) clutch means operable only when said shaft means is in said second position for transmitting rotary movement of said shaft means to said cam drum.

2. The assembly defined in claim 1, wherein said releasable means includes a rotary latching means operable upon successive user movement to retain said cam means alternately in said first position and said second position.

3. The assembly defined in claim 1, wherein said releasable means includes a latching mechanism operable upon successive push-push actuation to alternatively maintain and release said switch cam means from said first position; and, bias means operable for urging said switch cam means to said second position.

4. The assembly defined in claim 1, wherein said clutch means is operable for transmitting rotary movement of said shaft means to said cam drum in only one direction of rotation and operable to be overrunning in the opposite direction.

5. The assembly defined in claim 1, wherein said shaft means includes clutch means operable when said switch cam means is in said first axial position to enable said shaft means to be freely rotated with respect to said cam drum, and operable in said second axial position to transmit rotary motion from said shaft means to said cam drum.

6. The assembly defined in claim 1, wherein said switch cam means includes a member disposed on said shaft means and having an annular tapered surface thereon for contacting said slider means.

7. The assembly defined in claim 1, further comprising means operable for biasing said slider means to said second position and means operable to bias said shaft means to said second position.

8. A push-push reset electromechanical programmer assembly comprising:

(a) a housing means;

(b) programmer cam means having at least one program cam track thereon and mounted for rotary movement on said housing means;

(c) motorized advance means associated with said base means and operably connected to effect rotary movement of said cam means;

(d) program switch means including cam follower means operative to make and break a set of electrical contacts in response to said advancement of said cam track, said contacts adapted for circuit connection for controlling current to an electrical load;

(e) line power switch means disposed on said housing means and operative, upon connection to a source of power, to control current flow to said motorized advance means and to said program switch means, said line switch means including second cam follower means;

(f) shaft means disposed concentrically with respect to said program cam means for axial and rotary movement with respect thereto, said shaft means including line switch cam means movable with respect to said base means, said shaft means operable, upon user movement to a first axial position, to cause said line switch cam means to move to a position contacting said second cam follower means and effect closing of said line power switch means, said shaft means being freely rotatable with respect to said program cam means in said first axial position; and, (g) latch means operable to retain said shaft means in said first axial position, said latch means operable upon subsequent user axial movement of said shaft means to release said shaft means for axial movement to a second axial position and said line switch cam means moves to a position not contacting said second cam follower means, said shaft means operable in said second axial position to engage a clutch means to transmit rotary motion therefrom to said cam drum; and, (h) means operatively urging said shaft means from said first to said second position.

9. The assembly defined in claim 8, wherein said latch means includes a member rotatable with respect to said shaft means and having certain surfaces thereof engaging said line switch cam means to permit axial movement thereof.

10. The assembly defined in claim 8, wherein said line switch cam means includes clutch means operable when engaged, to effect rotary movement of said cam drum with said shaft means.

11. The assembly defined in claim 8, wherein said line switch cam means includes clutch means operable when axially engaged, to effect rotary movement of said cam drum when said shaft means is rotated in one direction, said clutch means being overrunning when said shaft means is rotated in a direction opposite said one direction.

12. The assembly defined in claim 8, wherein said latch means includes a member rotatable with respect to said shaft means.

* * * * *